United States Patent [19]

Prescott

[11] Patent Number: 4,536,103

[45] Date of Patent: Aug. 20, 1985

[54] ADJUSTABLE MANHOLE FRAME AND METHOD OF CONSTRUCTION AND INSTALLATION

[76] Inventor: Everett J. Prescott, P.O. Box 600, Gardiner, Me. 04345

[21] Appl. No.: 523,743

[22] Filed: Aug. 16, 1983

Related U.S. Application Data

[63] Continuation-in-part of Ser. No. 425,946, Sep. 28, 1982, , which is a continuation-in-part of Ser. No. 263,065, May 13, 1981, , which is a continuation-in-part of Ser. No. 180,394, Aug. 22, 1980, abandoned.

[51] Int. Cl.[3] ..... E02D 29/14; B29C 1/12

[52] U.S. Cl. ..... 404/26; 52/21; 249/11; 249/160; 264/32; 264/278

[58] Field of Search ..... 404/2, 4, 25, 26; 52/19, 20, 21; 210/163, 164, 165, 166; 264/31, 32, 35, 278; 249/83, 85, 88, 91, 93, 144, 148, 149, 160, 11

[56] References Cited

U.S. PATENT DOCUMENTS

| | | | |
|---|---|---|---|
| 736,586 | 8/1903 | Dougherty | 249/149 |
| 823,963 | 6/1906 | McNamire | 249/160 |
| 1891160 | 12/1932 | Jespersen | 249/148 |
| 2,593,918 | 4/1952 | Redman | 404/26 |
| 3,815,214 | 6/1974 | Kyle, Sr. | 249/145 |
| 3,976,276 | 8/1976 | Watson | 249/149 |
| 4,188,151 | 2/1980 | Hall | 404/26 |
| 4,318,880 | 3/1982 | McIntosh et al. | 264/32 X |

*Primary Examiner*—Stephen J. Novosad
*Assistant Examiner*—Bruce M. Kisliuk
*Attorney, Agent, or Firm*—William Nitkin

[57] ABSTRACT

An adjustable cast iron or ductile iron manhole frame and method of construction utilizing a formed concrete base or a base of brick and cement mortar that supports both the frame and the pavement. The height and angle of the frame are determined by the method of construction which sets the height and angle of the formed concrete base. The frame is further adapted to receive and hold the manhole cover, and the frame includes an arched section to hold it securely to the concrete base or to filler material when in a raised position.

19 Claims, 6 Drawing Figures

ADJUSTABLE MANHOLE FRAME AND METHOD OF CONSTRUCTION AND INSTALLATION

This application is a continuation-in-part of my previous application for an Adjustable Manhole Frame and Method of Construction, Ser. No. 425,946 filed Sept. 28, 1982 which is a continuation-in-part of my previous application of the same title Ser. No. 263,065 filed on May 13, 1981 which is a continuation-in-part of my previous application for an Adjustable Manhole Frame, Ser. No. 180,394 filed on Aug. 22, 1980, all now abandoned.

BACKGROUND OF THE INVENTION

1. Field of the Invention

The field of this invention resides in the area of manhole frames and more particularly relates to adjustable manhole frames.

2. History of the Prior Art

The standard practice in manhole installations is to supply pre-cast concrete manhole sections to be assembled on the job site. These manholes extend from the depth of the pipe to 12 inches below the road surface. This 12 inch space is for the installation of the frame and manhole cover which vary in height from 4 to 10 inches. The void between the bottom of the frame flange and the concrete manhole is filled with either brick or mortar, cement block and mortar, or pre-cast concrete rings mortared in.

After installation of the frame, available fill material consisting of gravel or a combination of gravel and dirt is deposited around the exterior of the manhole and frame, and the fill is then compacted with whatever means is available, leaving 2 inches or more on top for the final paving material. Invariably, settling occurs within a short period of time resulting in a separation and cracking of the final paving around the frame. This settling process develops potholes that require constant patching, and over a period of time seepage of surface liquids such as water, gasoline, oil, and in cold climate areas, water carrying salt causes deterioration of the support base under the frame. In areas of severe deep frost penetration, entire sections of frame and base are lifted above the road surface. A great number of structures have to be repaired which means digging out and rebuilding the bases.

Where all brick and mortar manholes exist in the older systems traffic shock along with freeze and thaw cycles loosen bricks in the cone section as deep as 2 feet or more below the road surface. This situation usually requires extensive excavation and rebuilding of the entire cone section.

At the present the vast majority of manhole frame members are of a non-adjustable type, therefore any needed change means digging them out to raise, lower, repair or replace worn or broken frames.

The horizontal stability of prior art frames having a flat base surface resting on the manhole cone or brick support depends upon the surrounding backfill and pavement to hold the frames in position. Frequently, especially during wet periods, such frames can be forced laterally out of position over the manhole which displacement helps initiate the deterioration of the frame support and ultimate collapse of the frame.

It has long been desirable to have a simple and easy way of providing an adjustable manhole frame member to avoid the necessity of digging up the entire manhole frame out of the ground which project entails a great deal of labor with air compressor equipment and jack hammers to cut through the pavement and to loosen the compacted fill with the accompanying great expense and traffic disruption. In addition, the base support may also have to be dug out and rebuilt due to instability of either or both frame and support base as inevitably traffic moves the frame while freeze and thaw cycles move and destroy the base.

In an attempt to raise manholes without the necessity of digging out the entire structure, a prior technology utilized ring members for placement upon existing frame cover seats into which the covers are replaced. These ring members have limited use as their minimum overall height is greater than the thinner layer of pavement used today. Also, if they are not carefully installed or do not properly fit the cover seat and cavity, they could be dislodged and cause traffic accidents.

Many attempts to create adjustable manhole frames have been made. One is the "Preko" adjustable manhole frame disclosed in U.S. Pat. No. 3,858,998 which includes a second frame within an outer frame with screw adjustment means to raise or lower the inner second frame member in relation to the outer frame member so that if the road is raised, one turns the screws on the manhole, and the inner frame will raise or lower the manhole cover to the desired height. These "Preko" adjustable manhole frames have not gained widespread usage in the industry because of their higher initial cost due to the complexity of machining that must be done to create them and to the inherent fear that the screw elements might jam and fail to operate after the frame had been installed for a long period of time.

Another adjustable type is the "self-level", a United Kingdom invention disclosed in U.S. Pat. No. 4,174,183. This frame is installed during paving operations which requires hot pavement and also the use of a pavement roller for compression of the paving material and the positioning of the frame. A special exterior concrete ring is also required which is mortared to the base manhole. This frame is limited to shallow height adjustments, and when the frame is raised, a void can be created that could trap water which, if frozen, could force the unit up into the traveled way. Further, unless care is taken to properly fill and compact around the frame exterior, surface and underground liquids could undermine and/or deteriorate the frame support.

SUMMARY OF THE INVENTION

It is an object of this invention to provide a stronger and more permanent frame support impervious to the elements that affect the present material of brick and mortar.

It is a further object of this invention to provide such stronger frame member in a design that provides a reliable and height-adjustable manhole frame which is simple in design and economical to produce and install.

It is yet still another object of this invention to provide a stronger and more permanent frame, cover and installation method in a design that assures long life, is not affected by traffic shock, and is impervious to the elements that affect present material.

My improved frame design incorporates all of the necessary features to provide lifetime strength and wearing qualities plus stability in any necessary position. The outer edge of the wide surface is tapered downward to prevent damage to either the frame or the plow or the scraper during snow or ice removal. The surface width and arched shape of the bottom of the rim frame make it much stronger and more durable than present types. The deep lettering pattern of the surface provides anti-skid protection and contains arrow designs to indicate positions for lifting the frame. The exterior vertical wall of the frame rim extends downward and contains a series of large openings and deep tabs or teeth that help secure the frame into the frame support member to prevent dislogdement. The above-mentioned openings extend into the main arch in the rim which with the tapered skirt design discussed below provides the major support of the frame. In addition these openings act as vents to allow air to escape during the pouring of the concrete frame support member and when these openings are filled with concrete the total support and retention area of the frame is greatly increased. Compact storage and safety of the frames is derived from the shape of the skirt.

The interior wall section or skirt of the frame is offset to provide stackability of frames in a manner that locks each frame into the cover cavity of the lower frames. This offset jog in the skirt design also provides greater frame stability when in a raised position as the upper angle of the exterior skirt then provides a wide void for the filler material and thus a greater surface support than is provided by the main arch and vent openings alone. The frame design is such that filler may be inserted and packed easily and thoroughly without the need of wide pavement removal around the exterior of the frame. The long frame skirt adds to the stability and provides maximum strength under the cover seat. Frame seats are machined deeper than cover thicknesses so that the cover is recessed below the frame's surface to eliminate plow damage and reduce traffic impact. Due to the exterior taper of the skirt, the frame may be angled sharply to meet the road grade while still maintaining vertical walls of the support base.

The basic structure of my improved adjustable manhole frame can consist of several solid and durable frame and pavement support members as follows: a concrete support formed in place between form members; or concrete support pre-cast at a location other than the job site then after the concrete is sufficiently cured the pre-cast unit is trucked to the job site and installed; or brick and mortar support is formed in place using one form member to expedite the placement of the frame and bricks or lastly the brick and mortar support can be formed in place without the use of forms.

The inner and outer form members may be made of steel or aluminum and are held apart a distance determined by the size of the base of the concrete manhole. There are a plurality of height adjustment devices that include hooks at the ends thereof that are adapted to be inserted under the outer rim of the iron frame. These height adjustment hooks are attached to a bracket that rests on the top rim of the inner form or the bracket may be supported on three lifts that engage supports on the inside of the form. These lifts are used to raise the frame a few inches above the form thus eliminating the need if necessary of stacking a second form to raise the frame above the first form. Each inner form also has one or more devices that expand or contract it, such as turnbuckles or levers. The lower section of the inner form is expanded to grip the inner surface of the concrete or brick manhole while the upper section is expanded to grip the iron frame and support it during the concrete pouring process. Each outer form also has one or more devices for its expansion and contraction. The lower portion of the outer form contracts to grip the outer wall of the concrete manhole while the upper portion of the form is contracted to create an inward slope of the concrete support to be poured. This slope is a deterrent to lifting of the concrete support by freezing action of the exterior back fill. Each form also includes a number of leveling devices disposed at the lower portions of the forms. These leveling devices rest on the concrete manhole and keep the forms in the desired position. In the event that the manhole is so deep in the ground that the forms are not high enough to reach the surface level and accomplish the installation, there can be provided inner and outer stack support members, each with provisions for stacking a second set of forms above the first set.

Where undersize frames are used that create a void between the form and the cone opening, a set of spacer plates is used around the exterior of the inner form and rest on the inner edge of the cone. These plates are held by the leveling devices and after the poured concrete has set, they are removed for reuse.

After the forms are positioned on the concrete manhole structure in the ground, the height adjustment hooks are then inserted under the frame. The frame can now be elevated thereby to the proposed or actual road level and angle. The form expansion devices are expanded to hold the inner form tight to the manhole and frame and the height adjustment bolts are removed. The concrete is then mixed and poured into the void under the frame and between the inner and outer forms and is pushed up into the arched areas of the frame. When the concrete has set, a trowel is used to remove excess concrete from the exterior of the frame rim and then to slope the concrete downward and away from the frame rim to the outer form to allow sufficient depth of pavement around the frame. The forms are later removed and the structure is then ready for paving.

An optional installation method that is desirable in high traffic areas and during low temperature periods such as experienced in northern winter climates is to pour the concrete for the frame support in some area other than in the street. First a depth measurement in four locations is made at the site by removing the manhole cover and measuring from the road surface to the concrete manhole. Then the frame and forms may be set up elsewhere on a surface to which the concrete will not adhere and the concrete poured and the excess material removed. The frame support is allowed to cure and then it is transported to the manhole site and installed as described in detail below.

Where brick and mortar manholes have deteriorated not only in the frame support area but also throughout one or more brick layers in the upper cone area, the frame and concrete support can be extended around the exterior of the brick cone to protect the bricks from further ground pressures and give the entire cone area and frame support stability and permanency.

When new sewer lines are installed, the roadway invariably settles leaving the manhole high and subjected to severe traffic impact. In freezing areas the manhole is additionally subjected to breakage by snow-removing vehicles. The frame of this inventior can be installed an inch or more below finish grade and raised with filler material to the paving height. After the roadway settles, the frame can be lifted off and some or all of the filler removed to easily lower the frame and cover.

In order to raise a manhole frame at a later time, bars or digging picks are driven through the pavement into lift holes formed in the iron frame that are indicated on the top surface of the frame by an arrow design. The frame is pried up to the height of the new grade and blocked up with wedges.

Cement slurry is then packed into the void between the frame and frame support and the surface is later repaved.

Another desirable feature of the frame design is the ability to stack frames for storage and transportation. The skirt location and interior shape are such that the skirt fits into the cover cavity of the lower frame. The area needed to store a plurality of these frames is less in both vertical and horizontal dimensions.

In extemely severe locations such as very steep inclines where heavyweight and/or high volume traffic is encountered, the frame can be securely locked to the concrete, both in its original installation and after being raised or lowered. Frames are provided with two opposite holes in the lower end of the skirt, and prior to pouring the concrete frame support, two steel rods are inserted through these holes and extended into the area where the concrete will be poured. Later, should height change be necessary these pins are retracted, the frame repositioned, its new height holes drilled at the new depth, and the pins are reinserted.

DESCRIPTION OF THE PREFERRED EMBODIMENT(S)

Figure 1:
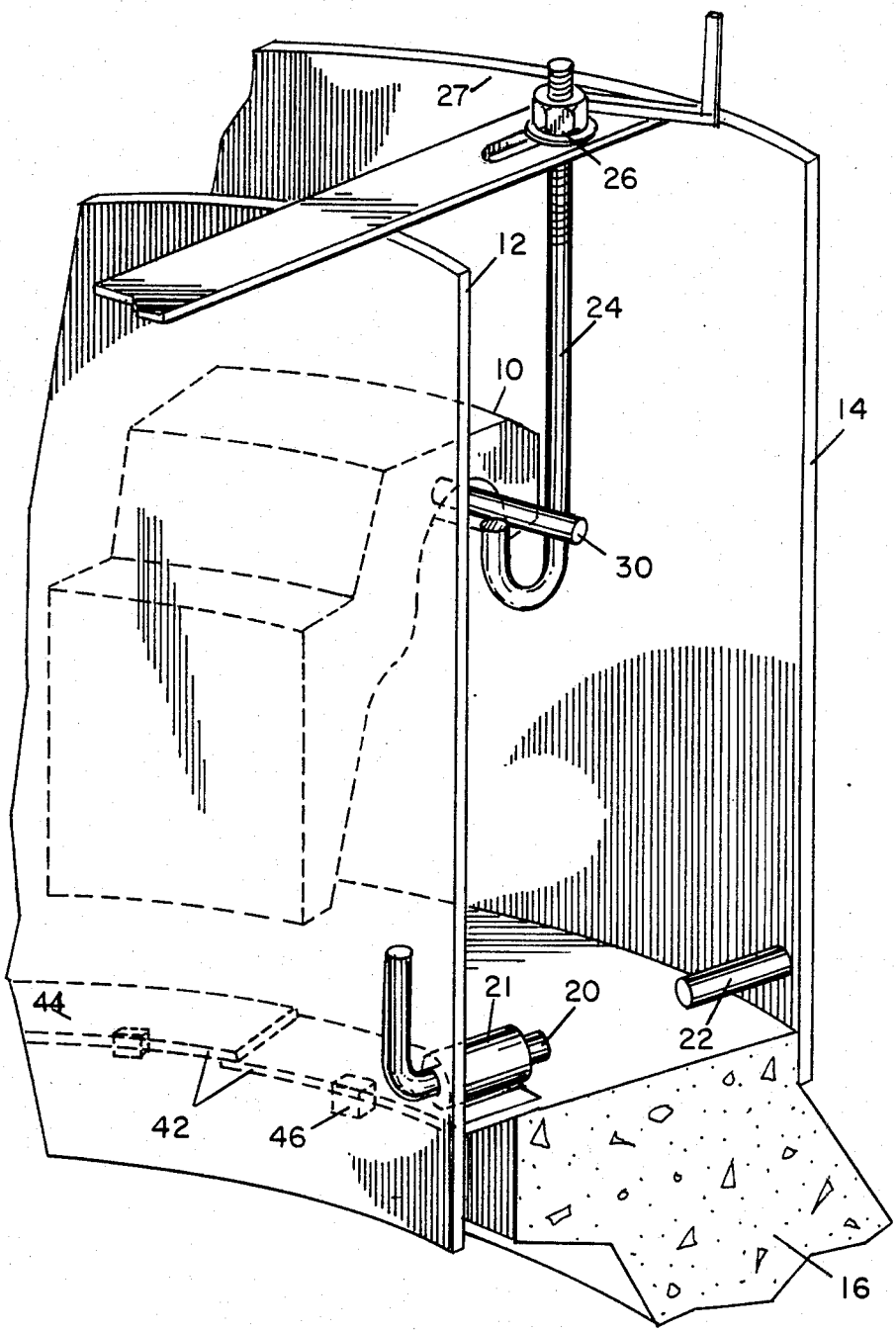
FIG. 1 illustrates a cross-sectional view through a side of the adjustable manhole frame of this invention.
Figure 2:
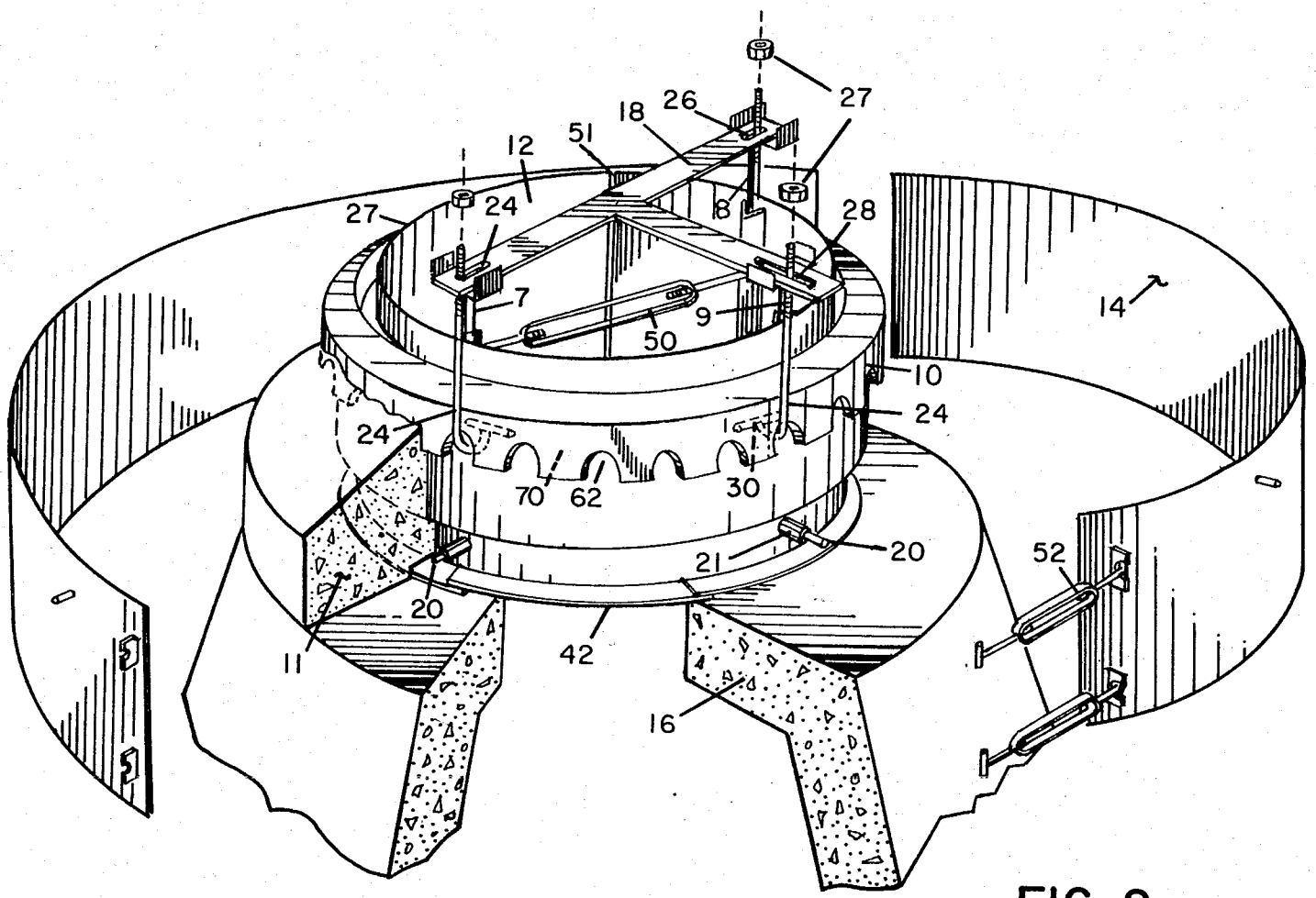
FIG. 2 illustrates a perspective elevational view of the frame support with the outer form opened.

FIG. 1 illustrates a cross-sectional view through the side of the adjustable manhole frame of this invention during its installation on top of the manhole cone. Seen in this view on the inside of cone 16 is positioned inner form 12. On the outside of manhole 16 is positioned outer form 14. These inner and outer forms are provided with means to expand or contract them as seen in FIG. 2, being a split within the ring such as inner form split 51 which allows the form to pass by itself when turnbuckle 50 is tightened or expanded. An outer form expansion member turnbuckle 52 can be provided to close the split on the outer form but a long bolt can also be used. More than one expansion/contraction member can be provided, each at different levels along the height of the form. In practice the base of the inner form is tightened, expanding outwardly against the inside of top manhole cone 16 and the base of the outer form 14 is tightened inwardly around the outside of the top of manhole 16. In some instances the inner form may not meet the inside top of manhole cone 16 or it may be desirable to use a frame member 10 of a different size then the diameter of the inner top opening of manhole cone 16. Therefore a series of inner leveling bolts 20 or equivalent unthreaded slide pins are disposed through the inner form 12 and extend outward to a point where they are adapted to rest upon and contact the top of manhole 16. There may be a plurality of these inner leveling bolts 20, two of which can be seen in FIG. 2. The same kind of leveling bolts or unthreaded slide pins can be used in outer form 14. The outer leveling bolts 22 or unthreaded slide pins, one of which can be seen in FIG. 1 and a series of which can be seen in FIG. 2, are adapted to rest upon the top of the manhole cone to support the outer form on top of the cone. When there is a space between the top of the manhole cone and the inner form, this space must be filled so that the concrete does not pour out between manhole cone 16 and inner form 12. A plurality of spacer plates 42 may be positioned so that they overlap one another and extend from the inner form, under leveling bolts 20 and onto the top of manhole cone 16. In one embodiment an attached sleeve 21 can be provided in the center of each spacer plate allowing the spacer plate to be connected to each inner levelling bolt to prevent loose spacer plates from falling into the void and being lost down the manhole. The spacer plates, of which there may be six in a desired configuration, overlap one another such as seen with spacer plate 44 overlapping spacer plate 42 in FIG. 1. A series of spacer plate removal tab members 46 are affixed each to the base of each spacer plate to grasp onto so taht they can be removed after the concrete has been poured and set and inner form 12 removed. The inner and outer forms as discussed above can be provided with more than one expansion or contraction member which may be an upper and lower expansion/contraction member so that the upper portion and lower portion of each form can be moved independently of one another. It is often desirable that the outer form's lower expansion member be tightened so that outer form 14 tightens against manhole cone 16. It is further often desirable to expand inner form 12 so that it will contact and tighten against the inside of manhole cone 16 at the inner form's bottom. It is best to position the spacer plates under the inner levelling bolts 20 before such tightening takes place.

Once the forms are in the desired position, one can position on the top of inner form 12 height adjustment device 18. If one wishes to raise the top of frame 10 higher than the top of inner form 12, three adjustable lift members 7, 8, and 9 seen in FIG. 2 can be attached to the inside of the form member extending thereabove and on each of which an arm of height adjustment device 18 can rest. In a preferred embodiment three hook members 24 hang down from height adjustment device 18 and can be utilized for the positioning of frame 10 at its desired height and angle inside and against inner form 12. Height adjustment device 18 consists of a T-shaped member whose arms extend beyond inner form 12. Apertures 24 and 26 and elongated aperture 28 are provided to receive hook members 24 which are threaded at their tops and on which are nuts 27 with handles to support them at various adjusted heights from height adjustment device 18. All apertures can be of the elongated type in some embodiments. The hook extending from aperture 28 is adjustable not only vertically by movement of said nut but also horizontally in the elongated aperture 28. Hook members 24 extend downward and curve around in a hook-like fashion at their bottoms ending in a crosspiece 30. This hooked portion passes easily through an arch in frame 10 and crosspiece 30 is retained by the lower downward extending portions of the arch. Crosspiece 30 does not extend horizontally a distance greater than the curvature of the frame and may be curved to match that curvature in some embodiments.

If the frame is to be at an angle, one then adjusts the hook member heights by rotating each respective nut so that the frame is at the proper angle to be parallel to the level of the paved road. If the frame is to be parallel with the manhole cone, one would set all the hook member heights the same. The height, though, is determined by measurement of the frame to the proper height of the roadway. Once the frame is securely positioned, the upper portion of the inner form is expanded so as to grip the frame tightly and then the height adjustment device and hook members are removed completely from the frame by loosening the nuts and lifting the hook members free of the frame. Frame 10 will still remain in position being held by the pressure of the inner form against it. The concrete is then poured forming frame support member 11 as seen in FIG. 2.

Figure 3:
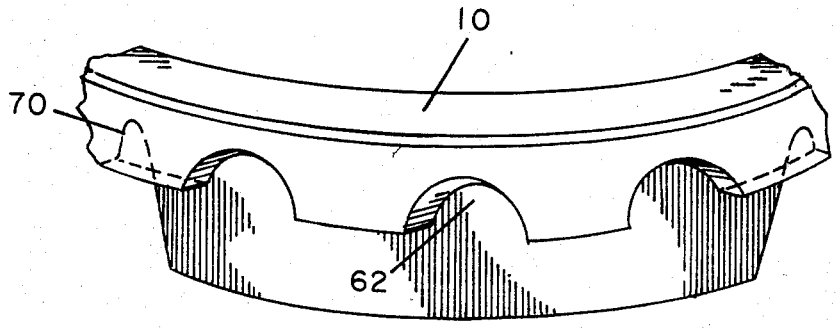
FIG. 3 illustrates an elevational view of a section of the frame showing the air escape vents.

The height of the frame can be adjusted by various other means as discussed below but in some embodiments one can set the frame lower than its normal position and then once the concrete of the frame support member has set, one can wedge the frame up and pack cement mortar material thereunder so that it is at the height of the road. Should it be desired to lower the frame in the future the pack material 81, once frame 10 has been raised up, can be removed. The frame then can be lowered to a new lower position should the roadway settle. The frame of this invention includes manhole cover seat 75 and a very deep arch 70 under its outer rim into which the concrete of the frame support member is forced. The concrete can reach up into the uppermost point of the arch by forcing it under arch 70 from which air escapes through air escape vents 62. These vents as seen in cross-section in FIG. 5 extend from the top of the arch upwards to a point near the top of the rim. Air escape vents 62 are also seen in FIG. 3 which shows their rounded and inwardly tapered configuration as seen in outline in FIG. 4. This configuration helps to allow the air to escape when forming the upper portion of the frame support member which holds frame 11 securely within the arch because of the high retention characteristics of the portion of the frame support member that extends up into the arch and air escape vents and prevents any undesirable movement of the frame. One can also use an air escape vent 62 as a pickhole to allow for the easy lifting of the frame by the insertion of picks under the rim of the frame into such vent. Outer form 14 also may have the expansion/contraction member at its top tightened more than at the bottom so as to create an outward downward slope of the outer edge of the frame support member 11 which shape increases the structural integrity of frame suport member 11. The outer slope of the concrete helps to prevent freezing ground from gripping the unit and raising it out of position.

To raise the frame should the need arise, one can pry up frame 10 by inserting rods into air escape vent 62 and raising the frame up to a new position and inserting wedges to hold it in place. Then cement slurry packing material 81, seen in FIG. 6, is packed thereunder to fill arch 70 above original frame support member 11.

Figure 4:
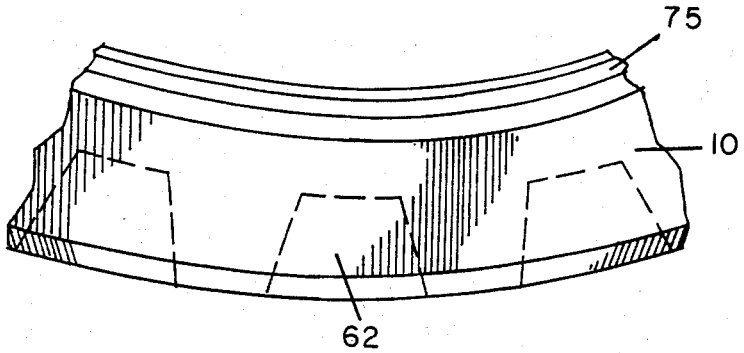
FIG. 4 illustrates a top plan view of a section of the frame.
Figure 5:
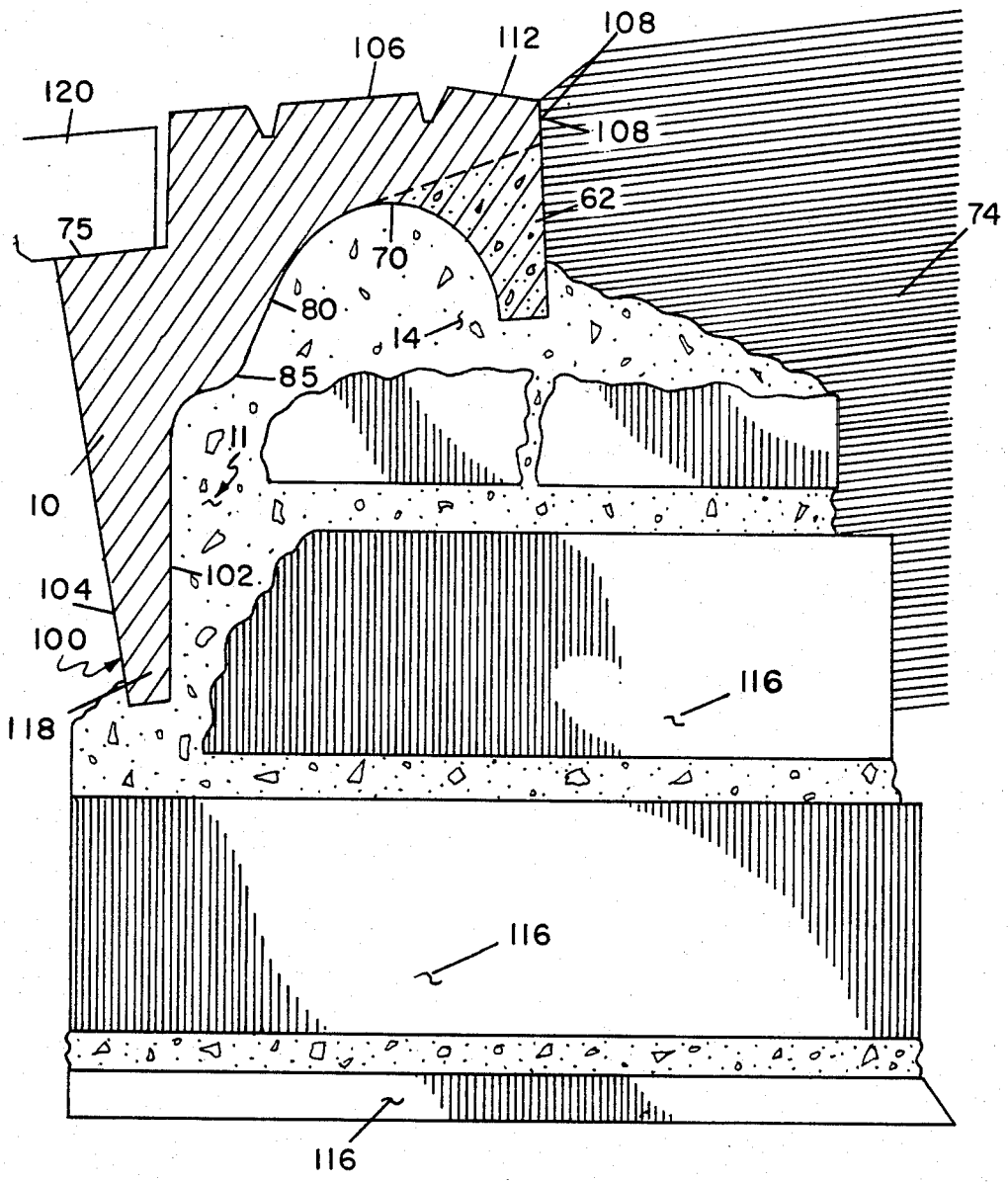
FIG. 5 illustrates a cross-sectional view of an inner frame with bricked-in support frame.

The design of frame 10 is critical to the success of this invention. It should also be noted that although this invention is illustrated and often referred to as relating to the circular type of manhole, it can also be utilized on square or rectangular manholes equally as well and such uses are contemplated within the spirit and scope of this invention. In FIG. 5 a cross-sectional view shows an embodiment with a bricked-in frame support 116. The use of an outer form is optional when using a bricked-in frame support. Frame 10 in the upper left-hand corner of this view has cover seat 75. The cover, a portion 120 of which is shown, is recessed below top rim 106 of frame 10. This position helps prevent the cover from being struck by any objects or vehicles around its upper edges. At the edge of the top of rim 106, the rim slants downwardly as top rim bevel 112. This slant helps prevent the edge of the frame rim from being struck by vehicles and the like and pavement 74 can also be bevelled to meet top rim bevel 112. Under top rim 106 is formed arch 70 which communicates to the outside of the side of rim 108 through a series of air-escape vents 62. Side 108 of the rim extends downward at an inward angle 110 which design helps to allow for later lifting of the frame. Vents 62 are also arch-shaped along side rim 108, the top of the arch of each air escape vent 62 being higher than the top of arch 70 and each air escape vent 62 communicating at a downward slant into the open area formed by arch 70. Also each air escape vent 62 can be tapered as it enters into arch 70 as seen in FIG. 4. The inward side of arch 70 continues downward to form the outer side 102 of skirt 100. Jog 85 recesses the base of outer skirt 102 which extends downward at an angle toward the inside of frame 10. The interior of frame 10 below seat 75 extends downward as inner side 104 of skirt 100 and tapers inwardly down to base 118 toward outer skirt 102.

Figure 6:
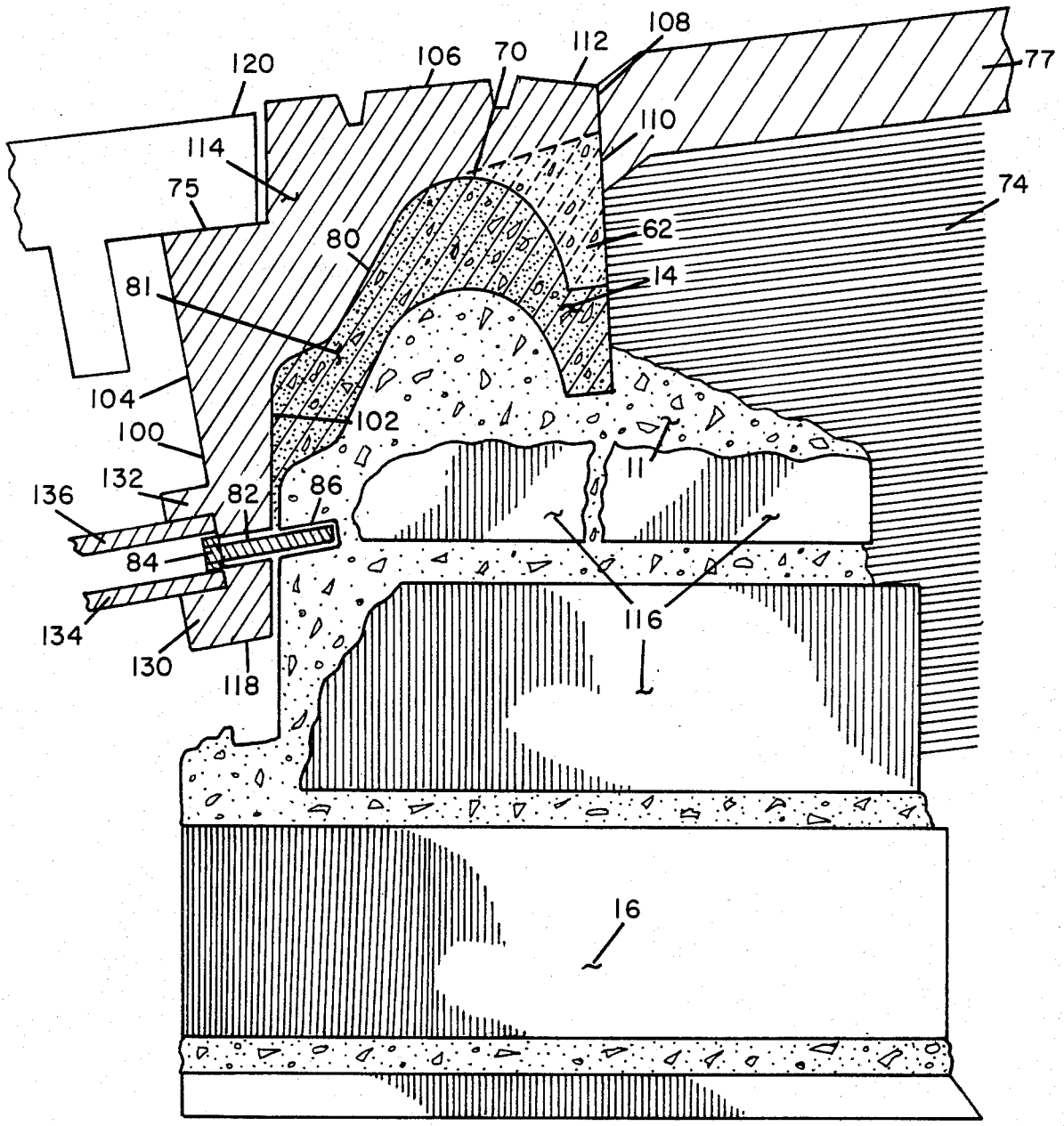
FIG. 6 illustrates a cross-sectional view of a frame raised from its original installation.

FIG. 6 shows frame 10 raised to a new level with projections 130 and 132 to retain the inner cover 134 and tightening bar 136 of manhole seals which are sometimes used in certain installations. New pavement 77 extends over to bevel 112 at the new frame height.

The outer inward slope 80 of arch 70 and skirt 102 must be at a sufficient angle to allow packing material 14 to be packed between it and the angular inner surface of frame support 11. It has been found that more packing material in area 81 helps to hold the frame securely. If the angle of the slope 80 of the skirt is too close to the vertical, it will be in too close proximity to frame support 11 when raised to allow for sufficient packing material therebetween. The more angle 80 of the skirt is to the horizontal, the greater the amount of packing material that can be placed between frame 10 and inner support frame 11 along the skirt and arch. Jog 85 helps make the frames stackable for storage by recessing the exterior base of the skirt so that the skirt will fit into manhole seat 75 of the next frame.

Frame 10 can be raised to as many new heights as are necessary to have the height of the manhole conform to the new surface level of the pavement. In the embodiment as discussed above where the frame support member is formed somewhat below the surface of the roadway to be formed and then the frame is raised up and pavement material packed thereunder, frame 10, if it is to be lowered at a future time, can then be raised up and the cement packing material 14 removed from above the concrete frame support member allowing frame 10 to be reset at a lower height than its original installation directly on top of the frame support member to conform to a situation where the roadway has settled. In some embodiments a series of apertures 82 can be provided near the bottom of the skirt through which can be inserted pins 84 which would pass through into apertures 86 made in the frame support member.

These pins are removable should the frame have to be moved but when the pins are in position, they help to retain the frame in place on the frame support member.

The frame support member can be formed away from the site of the manhole itself. In certain instances such as in areas of high traffic or in times of freezing weather, such frame support member can be formed in other locations and even indoors where the temperature might be above 50° F. In this procedure one would first measure from the road surface down to the cone. If there is a brick cone, one can first remove the top layer of bricks if they are badly deteriorated. If the road is crowned or otherwise at an angle, one may take several measurements around the perimeter of the manhole and then set the inner and outer forms up in the shop and position the height adjustment member and hooks supporting the frame at the distances determined from the measurements from the floor or surface which must be of a material to which the concrete will not adhere. In this procedure one should position some wires or rods into the concrete so as to allow it to be transported easily by lifting by means of the rods. When one transports the cast-in-shop frame support member, one can bring it to the site and dig down on the outside of the cone around 2 inches or 3 inches to remove any loose cement or brick. One can then place a mound of mortar or mastic on the center of the top of the cone and then quickly lower the concrete frame support member onto the cone to spread the seal around. One can then fill in any exterior voids with crushed stones and compact them.

One would then pave around the top of the frame with hot bituminous paving or coalpatch.

In some instances in order to determine the most ideal setting for the frame in relation to the road, it is desirable to have the finished pavement as close as possible to the frame at the pavement's completed level. Therefore one may form the frame support member somewhat below the final level so that the frame would sit below the level of the road. Then one would insert the cover on the frame and coat the entire frame and cover with a diesel fuel and pave the road right over the frame. Then one would dig out the top of the manhole cover and frame which will not adhere to the paving material and raise the frame now to the exact height of the paved road with pry bars and then hold it with wedges while filling in under the frame's arch with cement.

Although the present invention has been described with reference to particular embodiments, it will be apparent to those skilled in the art that variations and modifications can be substituted therefor without departing from the principles and spirit of the invention.

I claim:

1. A frame disposable in surmounting relation to a manhole cone to define a manhole opening at pavement level, the opening being closable by a manhole cover, the frame further being capable of adjustment relative to the cone and to the pavement level, comprising:

a body member having a centrally disposed opening defined at least in part by an inner skirt portion which extends substantially about the periphery of the opening, the body member having a planar upper surface normally disposed horizontally when installed relative to the cone, that portion of the planar upper surface proximate to and surmounting the inner skirt portion being recessed into the body member about the perimeter of the opening to define a peripheral seat for receiving and supporting the edges of the manhole cover, the body member further having an outer skirt portion spaced from the inner skirt portion and extending downwardly from the planar upper surface and substantially about the outer perimeter of the body member, at least a portion of the lower surface of the body member between the inner and outer skirt portions being arcuate and defining an arch-like channel disposed between at least portions of the inner and outer skirt portions, innermost surfaces of the channel having a slope which is angled relative to a line taken perpendicularly to the planar upper surface of the body member to facilitate installation and adjustment of the height of the frame relative to the manhole cone.

2. The frame of claim 1 wherein the channel is defined along outermost surfaces of the inner walls of the outer skirt portion, the innermost surfaces of the channel curving toward the inner skirt portion immediately adjacent the channel to define a shoulder portion of the body member adjacent outer wall surfaces of the inner skirt portion, the outer wall surfaces and inner wall surfaces of the inner skirt portion tapering respectively from the shoulder portion and the peripheral seat to terminate in a reduced-in-diameter base portion, the inner skirt portion thereby having a height which is greater than the height of the outer skirt portion.

3. The frame of claim 1 wherein the outer skirt portion has a plurality of vents formed therein to communicate the interior of the channel to that space externally of outer side walls of the outer skirt portion, air within the channel thereby being flushable through the vents on disposition of a material in the channel.

4. The frame of claim 3 wherein uppermost portions of the vents surmount the uppermost portion of the channel and extend toward said uppermost portions of the channel at a downward slant.

5. The frame of claim 4 wherein lateral walls of the vents are arcuate in shape to form arch-like openings in the outer side walls of the outer skirt portion.

6. The frame of claim 1 wherein peripheral upper surfaces of the body portion above the outer skirt portion slant downwardly toward outer side walls of the outer skirt portion at an angle to the planar upper surface of the body portion to prevent the upper periphery of the frame from being subject to direct engagement by extraneous objects when the frame is installed in a use environment.

7. The frame of claim 1 wherein the frame is annular in conformation and wherein the inner and outer skirt portions are annular and are concentric, the channel being annular and concentric with the inner and outer skirt portions.

8. The frame of claim 1 and further comprising removable support means carried by the manhole cone and formed against lower surfaces of the body member for supporting the frame relative to the cone and being removable to allow adjustment of the height of the frame relative to the cone.

9. A method for installing a frame in surmounting relation to a manhole cone to define a manhole opening at pavement level, comprising the steps of:

disposing a form in the opening of the manhole cover;

suspending the frame in place relative to and substantially about the outer perimeter of the form in spaced relation to the form;

adjusting outer contours of the form to expand the form to contact the form with the frame and thus support the frame in place in surmounting relation to the cone;

filling in spaces between upper portions of the cone and lower portions of the frame to support the frame relative to the cone; and, removing the form.

10. The method of claim 9 and further comprising the steps of:

disposing a second form about the outer periphery of the frame; and, flowing a settable material between the first-mentioned form and the second form and under the frame, the frame being supported by the material on setting.

11. The method of claim 9 and further comprising the steps of:

adjusting the height of at least portions of the frame prior to expanding the form, thereby to locate the frame relative to the cone.

12. The method of claim 11 wherein the form is expanded after the height of the frame is adjusted, thereby supporting the frame in place.

13. Apparatus for installing a frame in surmounting relation to a manhole cone having an opening, comprising:

a form disposed within the opening of the manhole cone;

means carried by the form for varying the effective size of the form; and, height adjustment means supported by the form for supporting the frame and for varying the height of at least portions of the frame relative to the cone, the form being expanded by the first-mentioned means on adjustment of the height of the frame relative to the cone to engage the form with the frame and support said frame, the height adjustment means thereby being replaced as the means for supporting the frame.

14. The apparatus of claim 13 wherein the height adjustment means comprise:

an adjustment element having three legs with an opening formed in each leg;

a rod having a threaded shank portion at one end and a hook-like element at the other end and being received one each in each opening, the shank portion extending through the opening and the hook-like element engaging and supporting the frame; and, nut means carried by the threaded shank portion of each of the rods for vertically adjusting the position of each rod relative to the leg carrying the rod, thereby to adjust the height of the frame relative to the cone at three points to allow leveling of the frame at a necessary orientation.

15. The apparatus of claim 14 wherein the element is T-shaped and a slot is formed in each leg of the T-shaped element to allow horizontal adjustment of the position of each rod.

16. The apparatus of claim 13 and further comprising means carried by the form for mounting the form on the cone.

17. The apparatus of claim 16 wherein the mounting means comprise pins connected to walls of the form and which contact upper surfaces of the cone about the opening to support the form on the cone.

18. The apparatus of claim 13 and further comprising a second form disposed about the outer periphery of upper portions of the cone, the forms enclosing the frame therebetween to allow flowing of a settable material between the forms and under the frame to provide a support for the frame relative to the cone on setting of the material.

19. The apparatus of claim 13 wherein the height-adjustment means comprise:

a T-shaped bracket member adapted to be positioned above said form, the bracket member having legs extending beyond said form and wherein said legs each have an aperture defined in those portions extending beyond said form; and, a plurality of hook members, each hook member having an upper threaded portion and a lower hooked portion, each positioned with its upper threaded portion engaged through one of said apertures in said T-shaped bracket and a nut member threadedly engaged on said upper threaded portion of said hook member above said T-shaped bracket arm, the lower hooked portion of said hook member being adapted to engage and support said frame at a selected height determined by the positioning of said nut member on said upper threaded portion of said hook member.

* * * * *